US005643020A

United States Patent [19]

Harris

[11] Patent Number: 5,643,020

[45] Date of Patent: Jul. 1, 1997

[54] PERSONAL WATERCRAFT

[76] Inventor: Herman R. Harris, 305 Idlewood Dr., Kannapolis, N.C. 28083

[21] Appl. No.: 696,324

[22] Filed: Aug. 13, 1996

[51] Int. Cl.[6] ..... B63H 16/20

[52] U.S. Cl. ..... 440/31

[58] Field of Search ..... 440/21, 26–31

[56] References Cited

U.S. PATENT DOCUMENTS

| | | | |
|---|---|---|---|
| 876,133 | 1/1908 | Beebe . | |
| 1,071,113 | 8/1913 | Teters | 440/27 |
| 1,277,022 | 8/1918 | Young | 440/31 |
| 1,578,584 | 3/1926 | Cromer | 440/27 |
| 1,729,974 | 10/1929 | Watson . | |
| 1,752,051 | 3/1930 | Young | 440/31 |
| 3,006,310 | 10/1961 | Penland et al. . | |
| 3,779,202 | 12/1973 | Martin et al. | 440/27 |
| 4,162,788 | 7/1979 | Turnier . | |
| 4,348,779 | 9/1982 | Leber | 114/345 |
| 4,360,396 | 11/1982 | Marbach | 114/346 |
| 4,698,034 | 10/1987 | Anthonijsz | 440/27 |
| 4,772,237 | 9/1988 | Zalkauskas | 440/30 |
| 4,984,648 | 1/1991 | Strzok | 440/97 |
| 5,368,507 | 11/1994 | Harris | 440/29 |

FOREIGN PATENT DOCUMENTS

| | | | |
|---|---|---|---|
| 408131 | 3/1910 | France | 440/96 |
| 631815 | 12/1927 | France | 440/26 |
| 989871 | 9/1951 | France | 440/97 |
| 2 270 905 | 12/1975 | France | 440/27 |
| 2 272 412 | 5/1994 | United Kingdom | 440/27 |

OTHER PUBLICATIONS

Author (unknown), "Introducing the most unique inflatable going.", Spring, 1993, Marklin Catalog.

Pedal Lounge, Sevylor®.

*Primary Examiner*—Jesus D. Sotelo

*Attorney, Agent, or Firm*—Bell, Seltzer, Park & Gibson, P.A.

[57] ABSTRACT

A personal watercraft having a pair of pedal-driven impellers. The watercraft includes an inflatable frame having substantially planar fore and aft portions which are slightly offset from each other. The fore frame portion includes a substantially planar support receiving the upper body of a user thereon. A drive shaft is mounted on the aft frame portion and has offset portions on which pedals are mounted for receiving the feet of the user. The impellers for generating thrust are rotatably connected to the drive shaft and are mounted on the aft portion of the frame. Accordingly, pedaled rotation of the drive shaft causes the impellers to generate thrust for pedalling the watercraft in the desired direction.

28 Claims, 4 Drawing Sheets

PERSONAL WATERCRAFT

FIELD OF THE INVENTION

The present invention relates to a personal water apparatus and, more particularly, to a personal watercraft which permits the user to pedal and propel the watercraft through water.

BACKGROUND OF THE INVENTION

Various recreational watercraft have been proposed for allowing users to mechanically propel themselves in bodies of water. Such devices are typically used for recreation, but can also provide a pleasurable method of exercising.

One such recreational water device is disclosed in U.S. Pat. No. 1,071,113 to Teters, titled "Swimming Appliance." The user lies generally prone in a bow member which is suspended from a substantially planar frame. The user pedals and propels the appliance by means of a rear propeller mounted on a shaft lying within the plane of the frame. Thus, the thrust of the propeller includes a vector component which is directed at an angle upward which, when translated to the intended horizontal motion of the water device, results in an inefficient use of thrust. When in use, both the stern and bow of the swimming appliance are submerged in the water with the stern significantly submerged beneath the water, substantially below the bow, thereby positioning the user in an unnatural position. That is, the user is awkwardly positioned with its entire body submerged beneath the surface of the water and the user must hold its head above the water surface which, seemingly, strains the user's neck muscles. Further, the device to Teters includes a centrally positioned rear propeller which provides a less stable buoyant support and less efficient use of the thrust of the propeller than a device having two spaced apart propellers with thrust generated in the intended propulsion direction. Moreover, the propeller and associated gearing are exposed creating a potential danger both to the user and other nearby swimmers.

U.S. Pat. No. 5,368,507 to Harris, titled "Paddle Board", relates to a recreational aquatic device having a main body with a fore and aft portion which substantially extend along the same plane. While effective for its intended use, the apparatus includes a gearing mechanism having a plurality of gears for altering the gear ratios to reduce or enhance the pedaling action of the user.

U.S. Pat. No. 1,578,584 to Cromer, titled "Swimming Apparatus", discloses a recreational water device in which the user lies generally prone on an inclined support member. Two paddle wheels mounted on a pair of transverse shafts adjacent to the user's head are driven by a second pair of longitudinally extending shafts driven by a pair of rotatable pedals. The Cromer apparatus also has exposed moving parts.

A pedal-driven swimming support is also disclosed in French Published Pat. Application No. 73 46435. The swimming support is propelled by means of a propeller mounted on the rear of the frame. The pedals drive gear wheels which drive a flexible cable which in turn drives a propeller. As can be seen in FIG. 1, however, the device has a generally planar frame with the rearward end being submerged below the surface of the water. Thus, a component part of the thrust of the propeller is directed downwardly instead of in the horizontal direction in which the swimming support moves.

SUMMARY OF THE INVENTION

It is therefore an object of the present invention to provide a personal watercraft which overcomes the deficiencies of the prior art.

It is another object of the present invention to provide a personal watercraft that allows the user to operate the watercraft comfortably and efficiently.

It is yet another object to provide a personal watercraft with a compact and efficient drive mechanism in which moving parts are enclosed to avoid injury to the user or others.

It is yet another object of the invention to provide a personal watercraft having an inflatable and collapsible frame for easy storage and transportation.

It is still a further object of the present invention to provide a personal watercraft having a selectively and adjustably positioned drive mechanism to accommodate various users and for providing various uses for the present invention.

These and other objects and advantages of the present invention are achieved in the embodiments illustrated herein by the provision of an apparatus which comprises a personal watercraft having a frame with two pedal-driven impellets mounted on an aft portion thereof. The frame also includes a fore portion, and both portions include a pair of substantially parallel rails. In addition, the aft frame portion extends in a plane which is offset from the plane in which the fore frame portion extends.

A substantially planar support is mounted on the fore portion of the frame and includes a substantially flat portion, which is supported between the rails of the fore frame portion, for receiving the body of a user thereon and comfortably supporting a portion of the user's body above the water surface. In the preferred embodiment of the invention, the parallel rails of the fore portion, the aft portion and the planar support of the fore portion are inflated.

A drive shaft is rotatably mounted between the side rails of the aft frame portion and has a pair of offset portions on which pedals are mounted. Accordingly, when the user's upper body is positioned prone on the substantially flat portion, the user's feet will be received by the offset portions so that the user may rotate the drive shaft.

Connected to both ends of the rotatable drive shaft is a pair of impellets for generating thrust. The impellers are mounted adjacent the ends of the aft frame rails and generate thrust along axes which are offset from the plane of the aft portion, but which are substantially parallel to the plane of the fore portion. This arrangement provides a more comfortable and powerful pedaling position for the user, and also ensures that the generated thrust acts solely in the desired propulsion direction. Thus, when the user pedals and rotates the drive shaft, the drive shaft causes the impellers to generate thrust and the watercraft is propelled in the desired direction.

Each impeller includes an impeller shaft which is rotatably mounted. A bevel gear is connected to the drive shaft and a corresponding pinion gear is mounted on the impeller shaft. The impeller may also include a screw propeller mounted on the impeller shaft so that rotation of the drive shaft rotates the bevel gear, which rotates the pinion gear, thereby rotating the impeller shaft and the propeller to generate thrust along the direction of the impeller shaft axis. In the preferred embodiment, each impeller is removably attached to a respective side rail of the aft portion to permit the watercraft to be used without the impeller and to compensate for varying inflation levels of the aft portion of the watercraft. Additionally, attachments for the impellers are provided so that they may be selectively positioned along the length of the side rails of the aft portion.

The personal watercraft may also include a pair of tubular housings mounted to the rails of the aft frame portion for enclosing the impeller. These housings channel the water passing through the impeller to provide improved thrust and also protect the user and others from external moving parts. Buoyancy means, such as a buoyant outer enclosure can be positioned between the tubular housings and the side rails of the aft portion for providing added buoyancy at the aft portion of the frame and for sturdily supporting the tubular housings.

BRIEF DESCRIPTION OF THE DRAWINGS

Some of the objects and advantages of the present invention having been stated, others will appear as the description proceeds when taken in conjunction with accompanying drawings, which are not necessarily drawn to scale.

DETAILED DESCRIPTION OF THE PREFERRED EMBODIMENTS

The present invention will now be described more fully in detail with reference to the accompanying drawings, in which the preferred embodiments of the invention are shown. This invention should not, however, be construed as limited to the embodiments set forth herein; rather, the embodiments are provided so that this disclosure will be thorough and complete and will fully convey the scope of the invention to those skilled in the art.

Figure 1:
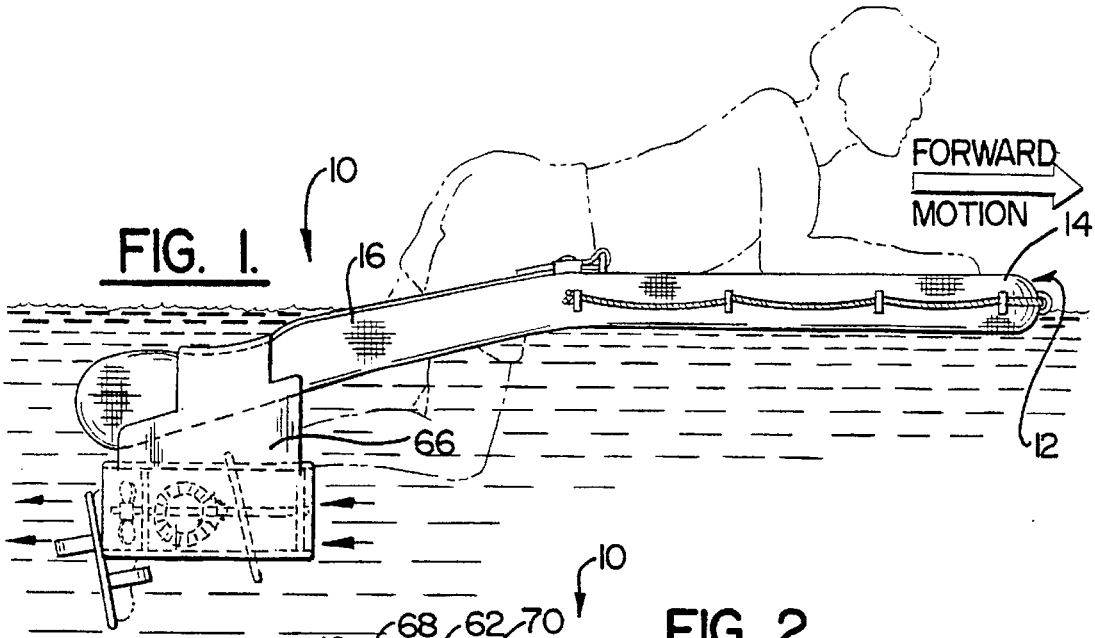
FIG. 1 is an environmental side elevation view of a personal watercraft of the present invention, illustrating the position of a user thereon.

Referring more particularly to the drawings, FIG. 1 shows one embodiment of a personal watercraft 10 of the present invention having a frame 12 with a substantially planar fore portion 14, an aft portion 16, and a pair of impellers 18 mounted on the aft frame portion 16. The fore and aft portions 14 and 16 may be offset by an angle $\alpha$, as discussed more fully below, and each includes two generally parallel side rails 20, 22, 24, 26. The side rails 20, 22, 24, 26 of each of the aft and fore portions 14, 16, in the preferred embodiment as shown, are inflated and formed of any durable, extensible, but lightweight material such as a flexible plastic or rubber. A useful material for this purpose is a rubberized canvas, for example.

Figure 2:
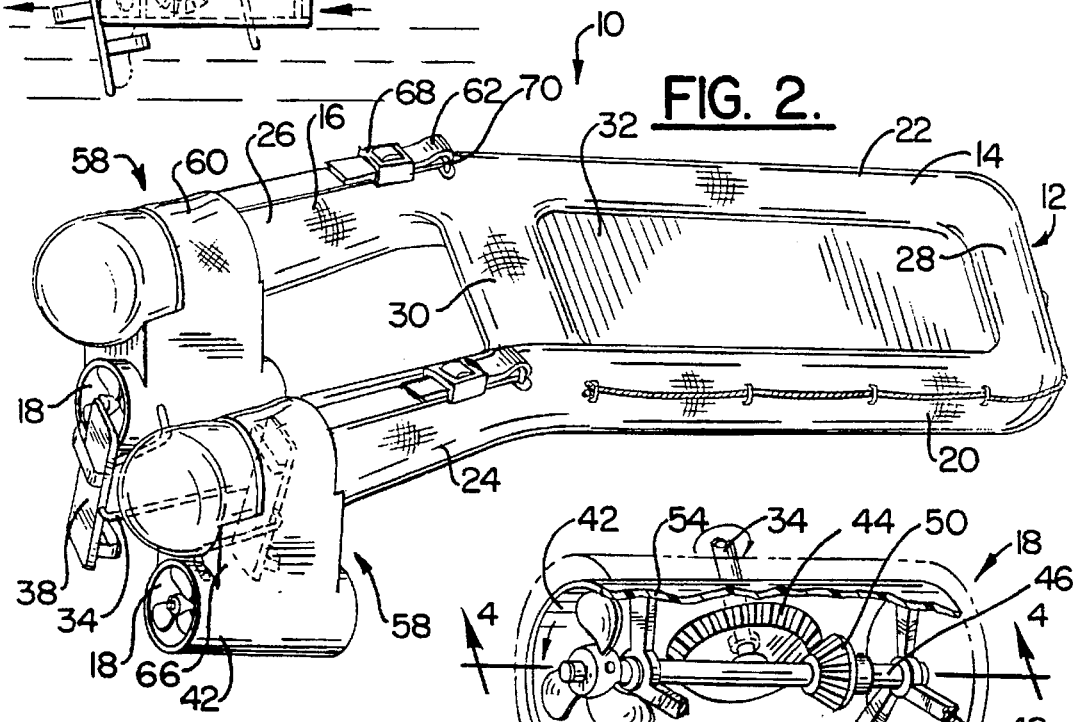
FIG. 2 is a perspective view of one embodiment of a personal watercraft according to the present invention.

As illustrated in FIGS. 1 and 2, the side rails 20, 22 of the fore frame portion 14 may be generally equal in length to the upper half of a user's body, and may be separated by a distance slightly wider than the user's body. Attached to the leading ends of the side rails 20, 22 of the fore portion 14 is a bow support 28, which, as shown, is annular and rests substantially horizontally upon the water surface. Optionally, the bow support 28, in an alternative embodiment (not shown), may be slightly upturned to minimize drag on the personal watercraft 10 when advancing through the water and to ensure that the watercraft rides over disturbances such as small waves in the water. The bow support 28 may be formed integral with the side rails 20, 22 and, preferably, are likewise inflated. In the case of heavier users, additional buoyant members (not shown) may be affixed to the bow 20 to provide extra buoyancy.

The side rails 20, 22 of the fore portion 14, the bow support 28, and a stern support 30 of the fore portion 14 define a substantially planar support 32. Preferably, the bow support 28 and stern 30 supports are integrally formed with the side rails 20, 22 of the fore portion 14 wherein a continuously inflated structure is provided. In the embodiment shown, the substantially planar support is configured to support at least a portion of the user's upper body to position the user in a natural and comfortable position. The planar support 32, as shown, is likewise inflated and, preferably is integrally formed with the bow and stern supports 28, 30 and side rails 20, 22 wherein all members are in fluid communication so that inflation of one member inflates the others. In an alternative embodiment, the substantially planar support 32 may be a net (not shown) or other flexible material suspended between the frame rails 20, 22, the bow support 28, and/or the stern support 30 for supporting the user's body thereon. In yet another alternative embodiment, the substantially planar portion 32 may be made of a panel of flexible buoyant material, such as a plastic or closed cell foam.

As shown, each of the sides 20, 22, 24, 26 of the fore and aft portions 14, 16 and the stern and bow supports 28, 30 may possess a substantially annular cross section. Also, each of these members, as well as the substantially planar support 32, may be inflated so as to provide buoyancy. It is within the scope of this invention, however, to provide non-inflated members for any or all of these components without departing from its intended spirit. Further, any of these components may include cross-section configurations other than annular configurations. As shown, the side rails 24, 26 of the aft portion 16 are wider than the side rails 20, 22 of the fore portion 14 to provide a sturdy support for the impellers 18.

A drive shaft 34 is rotatably mounted between the side rails 26, 24 of the aft frame portion 16. The drive shaft 34 has two offset portions 36 on which pedals 38 may be mounted for receiving the feet of the user. The pedals 38 may include foot straps 40 so that the user's feet will not slip when pedaling. As shown, a foot strap 40 is positioned on both sides of the pedals 38 and on opposing ends thereof so that the user may insert its foot in either strap 40 which is particularly convenient since the pedal 38 is pivotally mounted and freely rotatable upon the respective offset portion 36. The upper body or a portion thereof of the user thus lies prone on the substantially flat portion 32 in a position that allows a comfortable yet powerful pedaling action.

This pedaling position is enhanced by the planar offset $\alpha$ of the aft frame portion 16 relative to the fore frame portion 14. In particular, the fore 14 and aft 16 portions of the frame extend in planes which are tilted relative to each other by an angle $\alpha$. This angle is preferably from about 5°–20°, and more preferably, from about 18°–19°. As shown in FIG. 1, when the watercraft 10 is in use, the substantially planar support 32 of the fore portion 14 may be floating generally parallel to the surface of the water but the aft frame portion 16 may be submerged thereunder. This planar offset provides an improved pedaling position for the user and allows a more efficient use of the muscles involved in pedaling. In addition, the offset submerges the impellers 18 below the surface of the water to prevent the possibility of air being drawn into the impellers 18, which would decrease its efficiency.

The drive shaft 34 is rotatably mounted between the trailing ends of the frame rails 24, 26 of the aft frame portion 16. The drive shaft 34 extends beneath the frame rails 24, 26 and through tubular housings 42 of the impellers 18 so as to drive the two impellers 18 which are mounted on the undersides of the respective frame rails 24, 26. Although two impellers are illustrated and described, it will be understood that the present invention could be configured to operate with any number of impellers.

Figure 3:
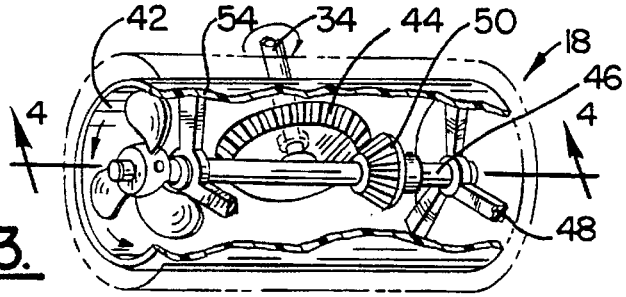
FIG. 3 is an enlarged and cut-away perspective view of an impeller of the present invention.

The ends of the drive shaft 34 extend into the tubular housing 42 for enclosing the impeller 18 to an impeller shaft 46. The tubular housings 42 help channel the water passing through the impeller 18 to provide improved thrust and also to protect the user and others from external moving parts. An added benefit of the tubular housings 42 is that they protect the impellers 18 from damage such as by unforeseen underwater obstacles or debris such as seaweed. Fitted to each end of the drive shaft 34 is a bevel gear 44, best illustrated in FIGS. 3 and 4, which is preferably made of a lightweight but wear resistant material, such as nylon.

The impeller shaft 46 is located within the tubular housing 42 and is generally coaxial with the housing 42. The impeller shaft 46 is rotatably supported at either end by two supports 48 which are strong enough to support the shaft but which are also of a sufficiently small frontal area to allow water to pass freely through the tubular housing 42.

A pinion gear 50 is fixedly mounted to the impeller shaft 46 between the shaft supports 48. The pinion gear 50 is beveled and is positioned to be in operative connection with the bevel gear 44. The pinion gear 50 may also be formed of any lightweight but wear-resistant material such as nylon.

Figure 4:
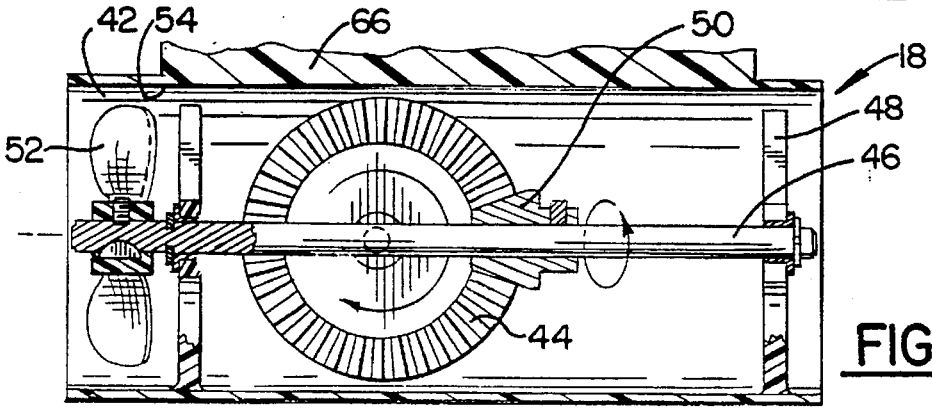
FIG. 4 is a sectional view of an impeller of the present invention, taken along line 4—4 of FIG. 3, which illustrates the rotation of the impeller parts.
Figure 5:
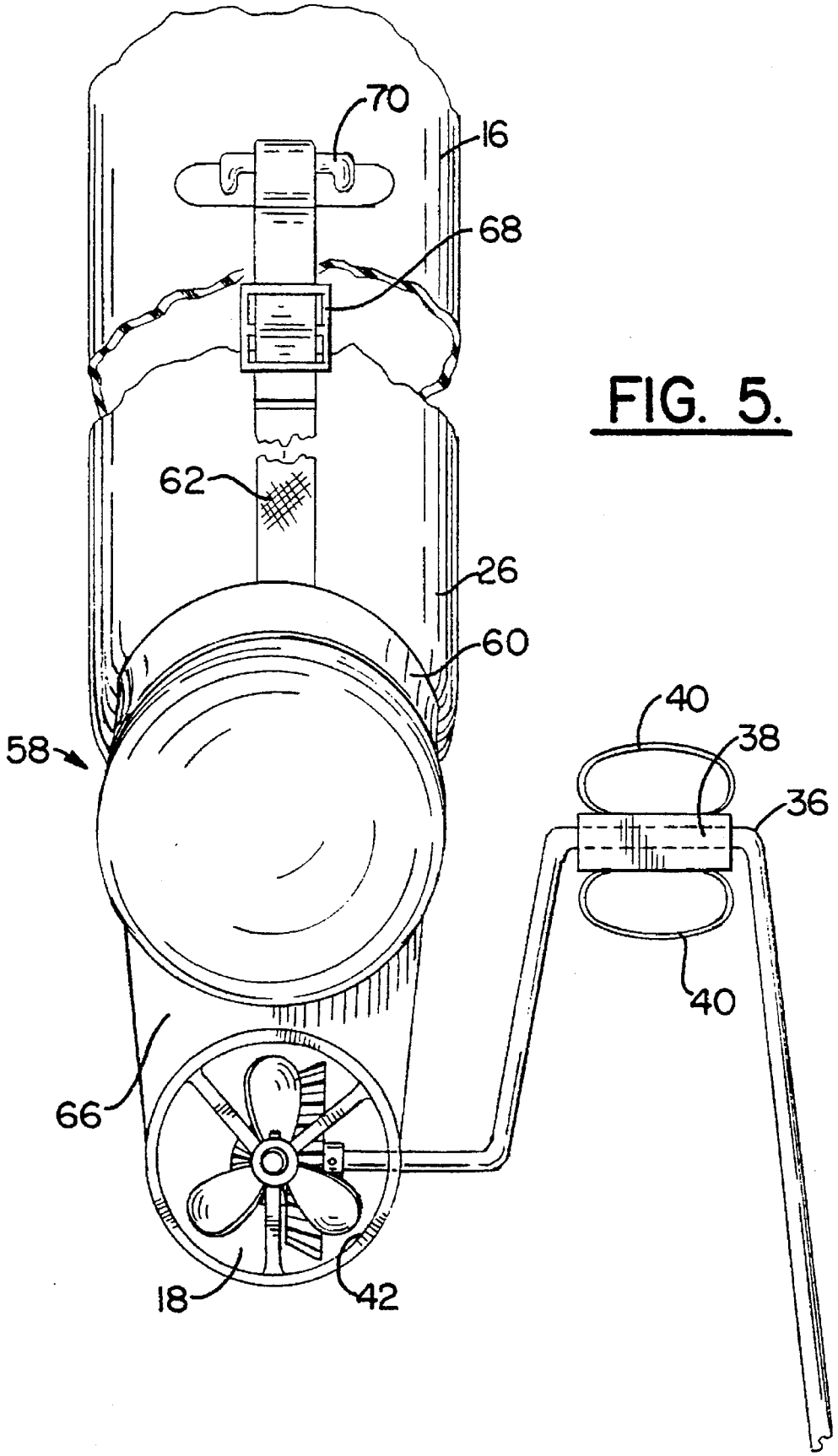
FIG. 5 is an enlarged, rear elevational view which illustrates a side rail of the aft portion having an impeller supported thereon.

As can be seen in FIGS. 4 and 5, the bevel gear 44 may be substantially larger than the pinion gear 50 so as to provide a gear ratio whereby the impeller shaft 46 rotates faster than the drive shaft 34. As would be understood, the gear ratio is dependent upon the relative sizes of the bevel 44 and pinion 50 gears and a preferred ratio is in the range of about 2:1 to 4:1. The ratio may be varied, however, to account for other factors such as the strength of the user, surface currents in the body of water and the desired speed of the watercraft 10.

A propeller 52 is attached to the aft end of the impeller shaft 46 downstream of the supports 48. Although a conventional screw propeller 52 is illustrated, it is to be understood that the term "impeller" as used herein, is intended to encompass all forms of devices which convert rotary mechanical power into propulsive thrust along a thrust axis. For example, the impeller might include more blades in a closer formation relative to the other blades and the inner surface of the tubular housing so as to resemble a turbine blade. The impeller may also resemble the impeller as used on modern powered personal watercraft, such as jet-skis, and have a generally cylindrical shape comprising one or more helical blades.

The left-hand (port) side impeller 18 may include structure which is the mirror image of the right-hand (starboard) impeller 18 illustrated in FIGS. 4 and 5. Accordingly, the left-hand impeller shaft 46 may rotate in the direction opposite to that of the right-hand impeller shaft 46 when the drive shaft 34 is pedaled. Accordingly, the propellers 52 of each impeller 18 have opposite pitch and are used for each of the impellers 18 so that they both provide forward thrust in response to forward rotation of the pedals 38. The counter-rotating impellers 18 are particularly advantageous inasmuch as they prevent an undesirable torque reaction which may tend to tilt the personal watercraft along its axis in a direction opposite to that of the shafts 34 if they rotated in the same direction. Also, the pedals 38 may be pedaled backwards which reverses the direction of thrust of the impellers 18 and causes the watercraft 10 to move backwards.

Another advantageous feature of the present invention is that the impellets 18 may provide thrust along thrust axes which are substantially parallel to the surface of the water and the desired direction of travel. More specifically, the tubular housings 42 and impeller shafts 46 are offset from the side rails 24, 26 of the aft frame portion 16 by the angle $\alpha$ so that they are substantially parallel to the fore frame portion 14. Accordingly, the thrust axes are parallel to the water surface and no vector component of the thrust acts in a direction other than the desired direction of travel. This provides for a more efficient use of the user's energy as opposed to an arrangement where the thrust is directed even slightly upward because, in the latter situation, a component part of the total generated thrust acts to push the watercraft 10 vertically out of the water and constitutes a waste of energy. In addition, as discussed above, this configuration prevents air from being drawn into the impeller 18 and results in uninterrupted thrust.

A buoyant support 54, such as a foam enclosure, may be affixed to the outside of each tubular housings. The buoyant support 54 may be formed of any high buoyancy material, such as closed-cell polystyrene foam, and provides extra buoyancy to ensure that the aft end of the watercraft 10 is maintained at the correct depth below the surface of the water.

In the embodiment shown, a spacer 66 is integrally formed with the tubular housing 42 and is positioned between the respective side rail 24, 26 and the tubular housing 42. The spacer 66 provides sturdy support for the impeller 18 against the respective side rail 24, 26 and directs the thrust components of the impellers 18 in a direction parallel to the plane of the fore portion 14, or in the direction of desired travel. Preferably, the spacer 66 and the tubular housing 42 are formed of the same material, such as a rigid plastic, or other (not shown) buoyant lightweight material. It is, however, within the scope of the present invention to omit the spacer 66. As shown, the spacer 66 includes an upper surface 67 configured to contact the side rails 24, 26 of the aft portion 16. To compensate for the offset angle $\alpha$ of the fore 14 and aft 16 portions, the upper surface 67 of the spacer 66 is likewise angularly positioned relative to one another by substantially the same angle $\alpha$. This positioning ensures that substantially all vector components of the generated thrust are directed in the intended direction of propulsion to efficiently use the user's pedaling efforts.

Figure 6:
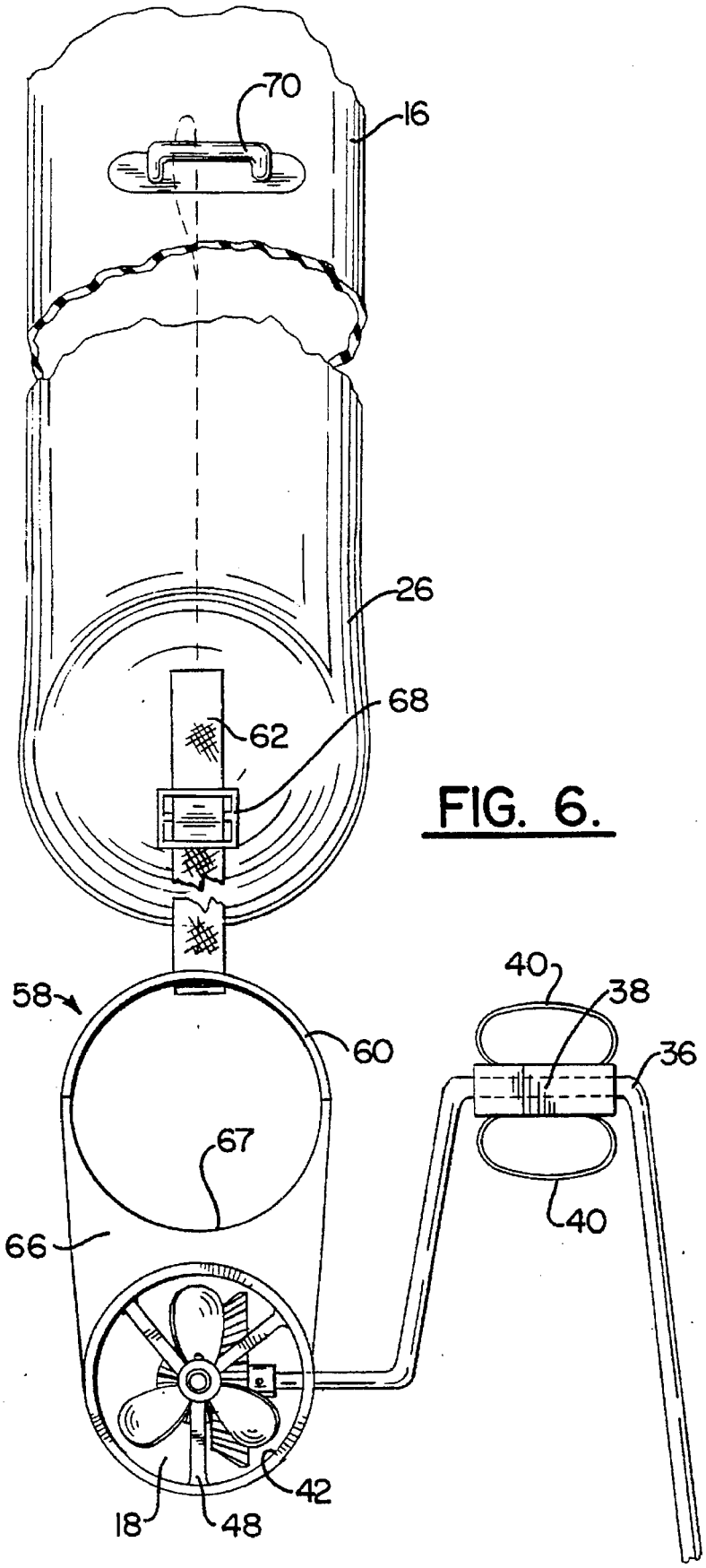
FIG. 6 is an enlarged, rear elevational view which illustrates a side rail of the aft portion having the impeller shown exploded therefrom.

The tubular housings 42 for enclosing the impellers 18 are adjustably and removably positioned along the length of the side rails 24 and 26 of the aft portion 16 as best illustrated in FIGS. 2, 5 and 6. A removable attachment 58 is provided for selectively removing and positioning the impeller 18 along the side rail 24, 26 of the aft portion 16. The removable attachment 58 includes a first supporting member 60 and a second supporting member 62 illustrated in the form of an adjusting band 62.

The first supporting member 60, in a preferred embodiment, is formed of a rigid material, such as plastic, and is preferably integrally formed with the tubular housing 42 and spacer 66. It is, however, within the scope of the present invention to provide a flexible band or other securing means for securing the impeller 18 along the side rails 24, 26 of the aft portion 16. It is also within the scope of the present invention that the tubular housing 42, the spacer 66, and the first supporting member 60 may be independent structures rather than portions of a unitary structure as shown.

As shown, the first supporting member 60 is a continuous member which is positioned so as to encompass the respective side rail 24 or 26 together with the respective impeller 18. The first supporting member 60 includes a central aperture which is smaller than the outer circumference the side rails 24 or 26 when the side rail 24, 26 is fully inflated. In this respect, to securedly position the impeller 18 onto the respective side rail 24, 26, the personal watercraft may be merely partially inflated. Once the impellers 18 are positioned on the side rail 24, 26, the watercraft 10, or respective side rail 24 or 26, may be further inflated. Also, if the personal watercraft 10 is used without the impellers 18 and it is desired to remove the impellers 18, the side rail 24, 26 may be deflated partially, the impellers 18 positioned thereon, and the side rails 24, 26 may then be fully inflated.

The second supporting member or adjusting strap 62 includes a buckle 68 wherein one end of the adjusting band is threaded through and around a rod 70 attached to the portion of the watercraft 10 adjacent the stern support 30 and the side rails 24 and 26. The ends are then secured by the buckle 68. The opposing ends of the adjusting straps 62 are secured or otherwise attached to the first supporting member 60. Accordingly, the adjusting band 62 may be shortened or extended in length to adjustably and selectively position the first supporting member 60, and hence, the impellers 18 along the length of the side rails 24 and 26 of the aft portion 16 to accommodate, for example, users of varying heights.

As illustrated in FIG. 5, the adjusting strap 62 is secured upon the respective rod 70 of the side rail 26 and the first supporting member 60 is secured along the same side rail 26 thereby supporting the impeller 18. If it is desired to remove the impeller, as illustrated in FIG. 6, the buckle need only be undone and the first supporting member supporting the impeller and the spacer 66 need only be removed from the side rail 26. This may be more easily accomplished by partially deflating the side rails 24, 26. Thus, the pedals 38 of the drive shaft 34 which are attached to the impellets 18 may be selectively positioned depending on the user's comfort position and relative height. Further, the impellers 18 may be removed and the watercraft deflated for easy transport and storage.

Figure 7:
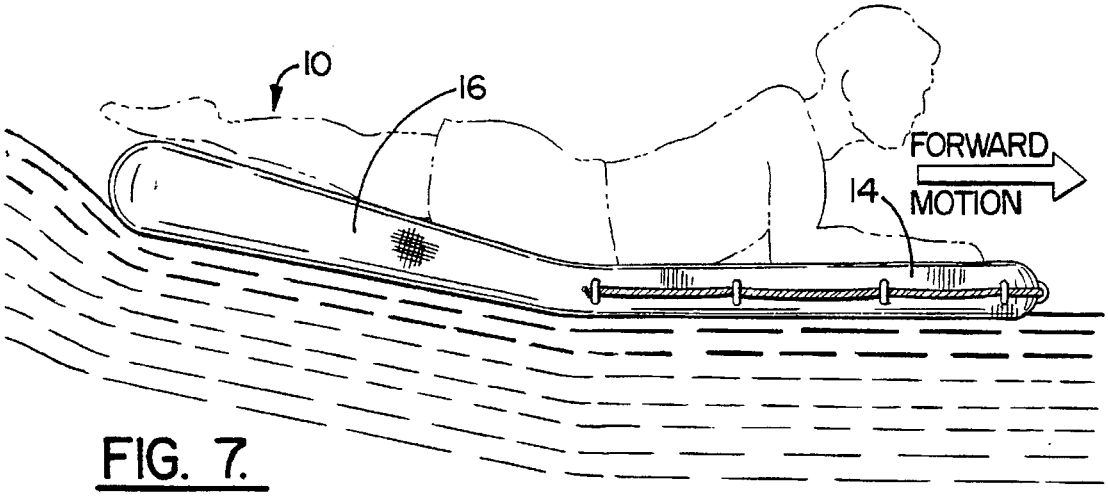
FIG. 7 is an environmental side elevational view of the personal watercraft according to the present invention used in an alternative manner.

As best illustrated in FIG. 7, it may be desirable to use the watercraft 10 without the impellets 18 or removable attachments 58 thereon. The watercraft 10, as shown in FIG. 7, may be turned over and act as a buoyant support for the user's entire body and be used for instance, in waves similar to a surfboard. This ability is enhanced by the upward sloping extension of the side rails 24 and 26 (once the personal watercraft is rotated) and the substantially planar support 32 which provides a supporting surface on either side thereof.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A personal watercraft for supporting or transporting a person along water, comprising:

a frame having a substantially planar fore portion and an aft portion, said aft portion extending in a plane offset from the plane in which said fore portion extends for supporting at least a portion of the person's upper body above a surface of the water;

a substantially planar support mounted on said fore portion of said frame and having a substantially flat portion for receiving the body of a user;

a drive shaft rotatably mounted on said aft portion of said frame and having offset portions on which pedals are mounted for receiving the feet of the user so that the user may rotate said drive shaft; and at least one impeller having a thrust axis offset from said plane of said aft portion and being rotatably connected to said drive shaft and mounted on said aft portion of said frame;

whereby pedaled rotation of said drive shaft causes said impeller to generate thrust for propelling the personal watercraft in the desired direction.

2. A personal watercraft as defined in claim 1 wherein at least a portion of said fore portion is inflatable.

3. A personal watercraft as defined in claim 2 wherein at least a portion of said substantially planar support is inflatable.

4. A personal watercraft as defined in claim 1 wherein at least a portion of said aft portion is inflatable.

5. A personal watercraft as defined in claim 1 wherein said impeller further comprises:

an impeller shaft rotatably mounted to said frame;

a bevel gear connected to said drive shaft;

a pinion gear mounted on said impeller shaft and operatively connected to said bevel gear; and a screw propeller mounted on said impeller shaft.

6. A personal watercraft as defined in claim 5 further comprising a tubular housing mounted to said aft portion of said frame for enclosing said impeller.

7. A personal watercraft as defined in claim 6 further comprising buoyancy means affixed to said tubular housing for providing buoyancy to said aft portion of said frame.

8. A personal watercraft as defined in claim 1 wherein said thrust axis is substantially parallel to said plane of said fore portion.

9. A personal watercraft as defined in claim 8 further comprising at least one spacer positioned between said impeller and said aft portion for positioning said impeller's thrust axis substantially parallel to said plane of said fore portion.

10. A personal watercraft as defined in claim 1 comprising at least two impellers, said aft portion being substantially defined by two parallel side rails wherein each of said side rails supports one of said at least two impellers.

11. A personal watercraft as defined in claim 1 wherein the plane of said aft frame portion is offset from the plane of said fore frame portion by an angle of about 5°–20°.

12. A personal watercraft as defined in claim 11 wherein the plane of said aft frame portion is offset from the plane of said fore frame portion by an angle of about 18°–19°.

13. A personal watercraft as defined in claim 1 wherein said fore frame portion comprises two generally parallel side rails and wherein said substantially flat portion for receiving the body of the user extends between said side rails.

14. A personal watercraft as defined in claim 13 wherein said aft frame portion comprises two generally parallel side rails.

15. A personal watercraft as defined in claim 13 wherein said drive shaft is adjustable along the length of said side rails of said aft portion.

16. A personal watercraft as defined in claim 13 further comprising a removable attachment for selectively removing said impellers from said side rails of said aft portion.

17. A personal watercraft as defined in claim 16 wherein said attachment comprises a first supporting member extending from said impeller to said side rail.

18. A personal watercraft as defined in claim 17 wherein said attachment comprises a second supporting member secured at one end to said side rail and extending along at least a portion of the length of said side rail, perpendicular to said first supporting member for securing said first supporting member in a desired position along said side rail.

19. A personal watercraft as defined in claim 1 wherein said drive shaft is adjustably positioned along the length of said aft portion.

20. A personal watercraft as defined in claim 1 further comprising a removable attachment for selectively removing said at least one impeller from said aft portion.

21. A personal watercraft, comprising:

a frame having a substantially planar fore portion and an aft portion, said aft portion extending in a plane offset from the plane in which said fore portion extends and said fore and aft frame portions each comprising a pair of substantially parallel side rails;

a substantially planar support mounted on said fore portion of said frame and having a substantially flat portion supported between said side rails for receiving the body of a user;

a drive shaft rotatably mounted between said side rails of said aft frame portion and having offset portions on which pedals are mounted for receiving the feet of the user so that the user may rotate said drive shaft; and a pair of impellers for generating thrust mounted one on each of said side rails of said aftframe portion and rotatably connected to said drive shaft to rotate in opposite directions, said impeller having thrust axes offset from said plane of said aft portion and substantially parallel to said plane of said fore portion; and whereby pedaled rotation of said drive shaft causes said impeller means to generate thrust for propelling the personal watercraft in the desired direction.

22. A personal watercraft as defined in claim 21 wherein each of said impellers further comprises:

an impeller shaft rotatably mounted to said frame;

a bevel gear connected to said drive shaft;

a pinion gear mounted on said impeller shaft and operatively connected to said bevel gear; and a screw propeller mounted on said impeller shaft.

23. A personal watercraft as defined in claim 21 further comprising a pair of tubular housings mounted to said side rails of said aft frame portion for enclosing said impellers.

24. A personal watercraft, comprising:

a frame having substantially planar fore and aft portions, each of said portions comprising a pair of substantially parallel side rails;

a substantially planar support mounted on said fore portion of said frame and having a substantially flat portion supported between said side rails for receiving the body of a user;

a drive shaft rotatably mounted between said side rails of said aft frame portion and having offset portions on which pedals are mounted for receiving the feet of the user so that the user may rotate said drive shaft;

a pair of tubular housings mounted on the outboard side of said side rails of said aft frame portion;

an impeller shaft rotatably supported within each of said tubular housings and operatively connected to said drive shaft; and a propeller mounted on the end of each of said impeller shafts;

whereby pedaled rotation of said drive shaft causes the impeller shafts to rotate which causes the propellers to generate thrust for propelling the personal watercraft in the desired direction.

25. A personal watercraft as defined in claim 24 wherein said aft frame portion extends in a plane offset from the plane in which said fore frame portion extends.

26. A personal watercraft as defined in claim 25 wherein said impeller shafts lie in a plane offset from the plane of said aft frame portion and parallel to the plane of said fore frame portion.

27. A personal watercraft as defined in claim 24 wherein said impeller shafts rotate in opposite directions in response to rotation of said drive shaft.

28. A personal watercraft as defined in claim 24 further comprising gear means for causing said impeller shafts to rotate faster than said drive shaft by a ratio of about 2:1 to 4:1.

* * * * *